United States Patent [19]

Stastny

[11] Patent Number: 4,817,163

[45] Date of Patent: Mar. 28, 1989

[54] LOUD-SPEAKER COMBINED WITH A DEVICE FOR PRODUCING LIGHTING EFFECTS

[76] Inventor: Erich Stastny, Parkstrasse 9, A-2521 Trumau, Austria

[21] Appl. No.: 11,620

[22] Filed: Feb. 6, 1987

[30] Foreign Application Priority Data

Feb. 17, 1986 [AT] Austria ..... 410/86
Feb. 2, 1987 [AT] Austria ..... 205/87

[51] Int. Cl.[4] ..... H04R 1/02

[52] U.S. Cl. ..... 381/150; 381/158; 381/188; 381/189; 381/193; 381/205; 362/279; 362/281; 40/433; 181/148

[58] Field of Search ..... 181/30, 143, 148, 161; 381/150, 158, 188, 189, 193, 205; 362/279, 281, 291, 296, 297, 342, 346, 348, 86, 87, 806, 811; 40/432, 433, 434

[56] References Cited

U.S. PATENT DOCUMENTS 1,884,724 10/1932 Keller ..... 181/148
2,083,753 6/1937 Turner ..... 362/86 X
2,891,338 6/1959 Palamara ..... 40/433
3,245,163 4/1966 Allen ..... 40/433

*Primary Examiner*—L. T. Hix
*Assistant Examiner*—Brian W. Brown
*Attorney, Agent, or Firm*—Remy J. VanOphem

[57] ABSTRACT

A loud-speaker is combined with a device for producing lighting speakers is covered by two discs provided with openings and, for example, being formed of a grating. The inner disc of the discs, which is facing the speaker cone is rotatable, whereas the outer disc is stationary. Rotation of the rotatable disc is driven either via a motor or via driver members fixed to the speaker cone of the loud-speaker which are actuated by transmission of the vibrations of the speaker cone to the rotating disc in order to provide rotating movement. Light sources for illuminating the surface of the inner or, respectively, outer disc, which is facing the light sources, are provided either within the speaker cone or outside of the loud-speaker. The lighting effects are then generated by the rotation of the inner disc.

15 Claims, 4 Drawing Sheets

IV
30
31
25
29
23
22
24
20
18
26
27
28
19
21
17

LOUD-SPEAKER COMBINED WITH A DEVICE FOR PRODUCING LIGHTING EFFECTS

BACKGROND OF THE INVENTION

1. Field of the Invention

The invention refers to a loud-speaker, combined with a device for producing lighting effects.

2. Description of the Prior Art

At social events, during which songs or music is transmitted by means of loud-speakers, there are, for example on occasion of a live performance by singers or musicians or on occasion of a reproduction of gramophone discs or sound tapes, also frequently produced lighting effects. Up until now, there were used for producing such lighting effects individual light sources of optionally different color and having continuously varied light intensity by controlling the electrical current supplied. This requires complicated electronic control equipment.

There are also known luminous display devices consisting of a light source in front of which rotate two mutual parallelly arranged discs in which are provided openings. In these devices different lighting effects result on account of the rotation of the discs, as represented, for example, by U.S. Pat. No. 3,245,163 to Allen.

SUMMARY OF THE INVENTION

It is an object of the present invention to provide a loud-speaker which simultaneously produces lighting effects, so that no separate equipment is required for this purpose.

It is a further object of the present invention to structure the loud-speaker such that, in spite of the simultaneous production of lighting effects, there results no substantial increase of the volume of the loud-speaker.

Finally, it is an object of the present invention to structure the loud-speaker such that the lighting effects produced vary depending on the sound waves emitted by the loud-speaker.

BRIEF DESCRIPTION OF THE DRAWINGS

In the annexed drawings, the invention is schematically illustrated with reference to the preferred embodiments.

DETAILED DESCRIPTION OF THE PREFERRED EMBODIMENTS

Figure 1:
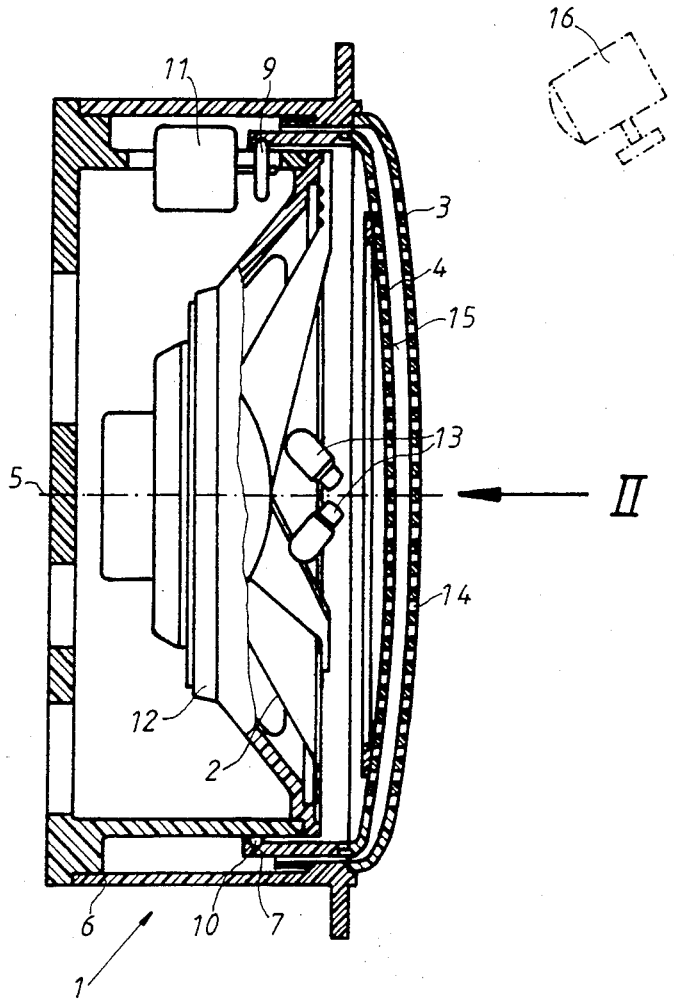
FIG. 1 shows a section through a first embodiment of a loud-speaker according to the invention along line I—I in FIG. 2.
Figure 2:
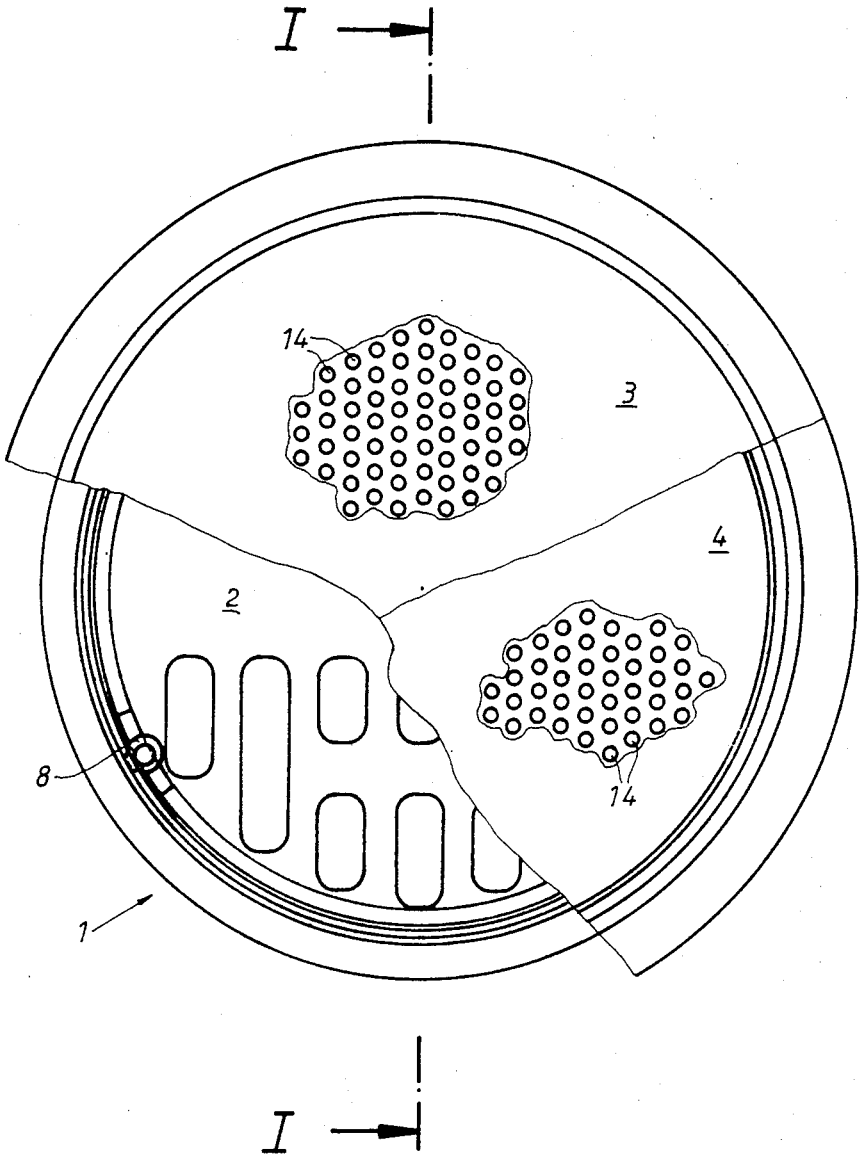
FIG. 2 shows a view of the loud-speaker according to the invention in the direction of arrow II in FIG. 1, noting that both gratings are, however, partially removed.

The embodiment shown in FIGS. 1 and 2 has a housing 1 of circularly annular cross section and having accommodated therein a speaker cone 2 of a loud-speaker 12. The housing is covered at its front side by an outer plate-like element 3 and by an inner plate-like element 4. The two plate-like elements are arranged in parallel, one relative to the other and can be plane elements or be, as is shown in FIG. 1, vaulted elements which include openings 14. The two plate-like elements 3, 4 conveniently consist of a grating or of a perforated disc, but the openings provided in both plate-like elements can also be configured in another manner within the scope of the invention.

Both plate-like elements 3, 4 have a circular circumference, the center of the circle being located on a axis 5 of the housing 1.

The outer plate-like element 3 is fixed to the side wall 6 of the housing 1, whereas the inner plate-like element 4 is arranged within the housing 1 for being rotatable around the axis 5 of the housing. For this purpose, the inner plate-like element 4 has a flange 7 extending substantially perpendicularly relative to the periphery of this element and is supported by means of rollers 8, 9 which are rotatably supported within the housing 1 and engage a groove 10 of the flange 7.

The roller 9 is driven by means of a geared motor 11 located within the interior of the housing 1 and is provided with a friction covering, so that the rotational movement of the roller 9 is transmitted to the flange 7 and thus to the inner plate-like element 4.

Within the interior of the speaker cone 2 of the loud-speaker 12 there are arranged light sources 13 formed of incandescent bulbs and illuminating that surface of the inner plate-like element 4 which is facing the speaker cone 2. The inner side of the speaker cone 2 is conveniently provided with a light-reflecting coating, so that the speaker cone 2 simultaneously serves as a reflector for the light sources 13.

The openings 14 of the outer plate-like element 3 and of the inner plate-like element 4 are indicated in FIG. 2. By rotating the inner plate-like element 4 around the axis 5 and relative to the stationary outer plate-like element 3, the relative position of the openings 14 of both plate-like elements 3, 4 is changed, which results in the desired lighting effects.

In place of the light sources 13 there can be arranged outside of the housing 1 one or several light sources such as is indicated at 16 in FIG. 1. The light sources 16 consist, for example, of spotlights which illuminate the outer surface of the outer plate-like element 3. When arranging these spotlights 16, the light sources 13 within the interior of the speaker cone 2 are omitted and the inner plate-like element 4 is made light-reflecting on its surface 15 facing the outer plate-like element 3, which results in the desired lighting effect.

The housing 1 can also be omitted and substituted therefor by a frame for fixing and supporting, respectively, thereon both plate-like elements 3, 4, which frame can, for example, be clamped at the marginal area of the speaker cone.

Figure 3:
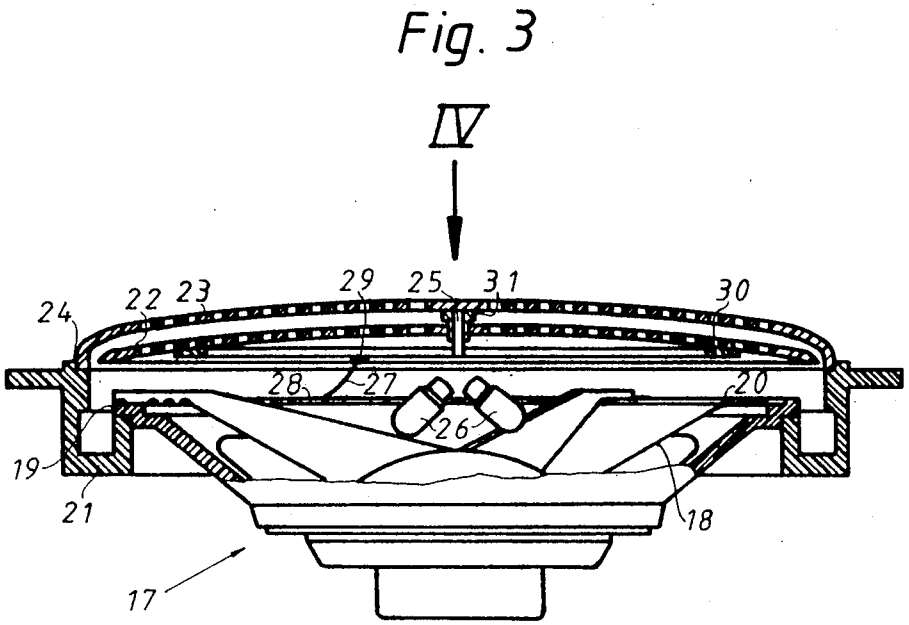
FIG. 3 shows a section through a second embodiment of the loud-speaker according to the invention along line III—III in FIG. 4.
Figure 4:
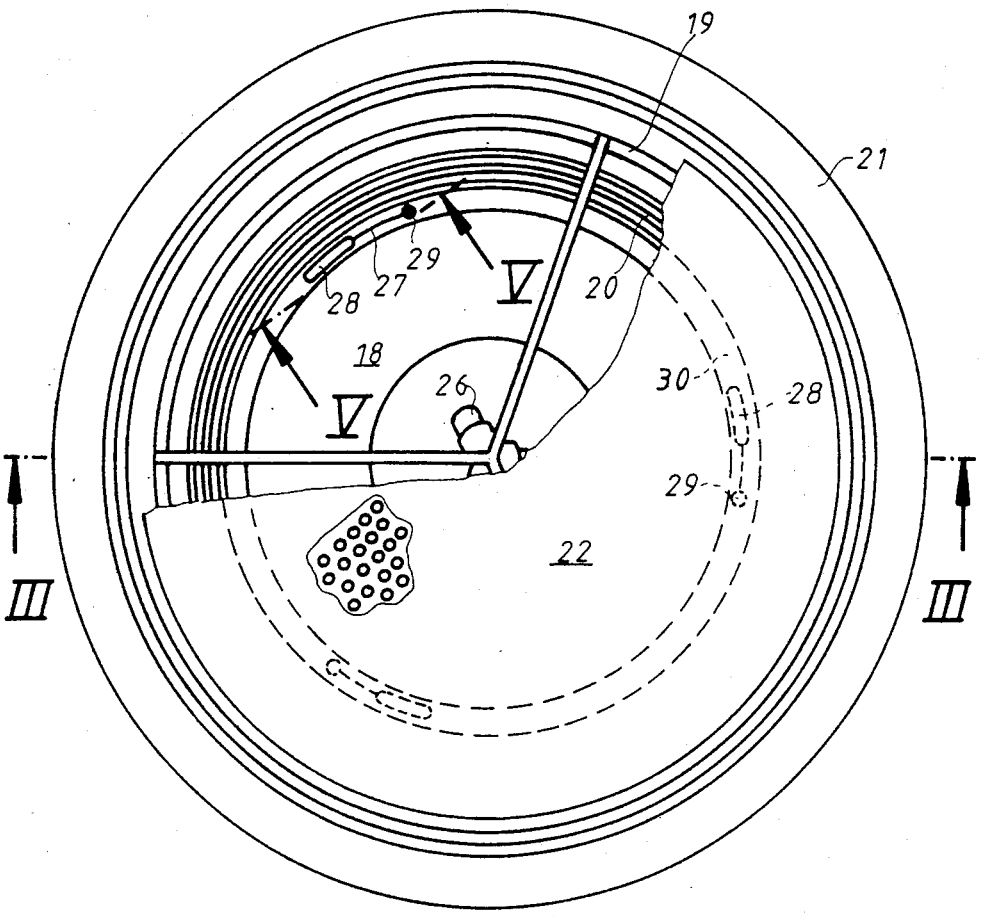
FIG. 4 shows a view of the loud-speaker according to the invention in the direction of arrow IV in FIG. 3, the outer grating being omitted and the inner grating being partially removed.
Figure 5:
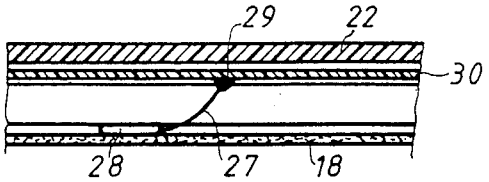
FIG. 5 shows a partial section along line V—V in FIG. 4.

An alternative embodiment of a loud-speaker 17 according to the present invention is shown in FIGS. 3 to 5 in which is included a speaker cone 18. The rim 19 of the loud-speaker 17 including the annular portion 20 extending in outward direction from the frustoconical portion of the speaker cone 18 is fixed within a frame profile 21.

The speaker cone 18 is covered by an inner plate-like element 22 and by an outer plate-like element 23. Both plate-like elements are of annular design and are arranged in parallel, one relative to the other, and may, like in the embodiment according to the FIGS. 1 and 2, be plane elements or vaulted elements. The two plate-like elements 22, 23 include equal openings and conveniently consist of a grating or of a perforated disc. The openings in both plate-like elements can, however, be formed in another manner within the scope of the invention.

The inner plate-like element 22 is rotatably arranged, whereas the outer plate-like element 23 is stationarily arranged and rests on the frame profile 21 by means of a flange 24. The outer plate-like element 23 has a bearing pin 25 on which is supporteda bearing 31 of the inner plate-like element 22, which provides the possibility to rotate the inner plate-like element 22.

Within the interior of the speaker cone 18 of the loud-speaker 17, there are arranged light sources 26 formed of incandescent bulbs which illuminate that surface of the inner plate-like element 22 which faces the speaker cone 18. The inner side of the speaker cone 18 is conveniently provided with a light-reflecting coating, so that the speaker cone 18 simultaneously serves as a reflector for the light sources 26. There result lighting effects during the rotating movement of the inner plate-like element 22 on account of the alternating coincidence of the openings within both plate-like elements 22, 23. The openings in the plate-like elements further serve the purpose of allowing the sound to leave the loud-speaker 17.

For the purpose of achieving the rotating movement of the inner plate-like element 22, there are, in the embodiment according to FIGS. 3 to 5, provided driver members 27 consisting of a wire which is bent according to the shape of a helix section and which is fixed at 28 by glueing, for example by means of an epoxy resin adhesive, to the outwardly protruding annular portion 20 of the speaker cone 18. The free end of the driver members 27 has a cap 29 formed of a sound-absorbing material, for example of rubber or of a rubber-like synthetic plastic material, and contacting a ring 30 extending in a direction to the speaker cone 18 and applied to the inner plate-like element 22 by a molding operation.

On account of the vibrations of the speaker cone 18 encountered during the operation of the loud-speaker 17, there is caused, in particular at frequencies between 60 and 120 Hz (cycles per second), a movement of the driver elements 27 which is transmitted via the caps 29 by frictional contact on the ring 30 and thus to the inner plate-like element 22 such that rotational movement of the inner plate-like element 22 around the bearing pin 25 is caused without requiring a separate motor or a similar drive means therefor. This embodiment has the additional advantage that the rotating speed of the inner plate-like element 22 is dependent on the momentary vibrations of the speaker cone 18 and is thus varied such that the lighting effects obtained are varied dependent on the frequencies and are adapted to the sound waves emitted by the loud-speaker 17.

Also in the alternative embodiment according to the FIGS. 3 to 5, the light sources 26 arranged within the speaker cone 18 can, like in the embodiment according to FIGS. 1 and 2, be omitted and be substituted by light sources arranged outside of the outer plate-like element 23 which illuminate the outer surface of the outer plate-like element. In this case it is, like in the embodiment according to FIGS. 1 and 2, necessary to provide that surface of the inner plate-like element 22, which is facing the outer plate-like element 23, with a light-reflecting coating, by means of which the light emitted by the light sources, by example formed by spot lights, arranged outside of the outer plate-like element 23 is reflected such that it equally results in the desired lighting effects.

What I claim is:

1. A loud-speaker in combination with a device for producing lighting effects, comprising an inner plate-like element and an outer plate-like element, said inner and outer plate-like elements being mutually arranged in parallel orientation of one relative to the other, said inner and outer plate-like elements having a plurality of openings, said inner and outer plate-like elements having a surface; said loud-speaker having a funnel shaped speaker cone, said inner plate-like element covering said speaker cone, said outer plate-like element covering said inner plate-like element, one of said inner and outer plate-like elements being movable relative to the other; means for moving said one of said inner and outer plate-like elements relative to the other; means for mounting said inner and outer plate-like elements in said parallel orientation of one relative to the other; and at least one light source illuminating said surface of one of said inner and outer plate-like elements.

2. The loud-speaker in combination with a device for producing lighting effects as claimd in claim 1, wherein said inner and outer plate-like elements have a circular circumference, said circular circumference defining a center; at least one of said inner and outer plate-like elements being supported for rotating movement around said center of said circular circumference.

3. The loud-speaker in combination with a device for producing lighting effects as claimed in claim 1, wherein each of said inner and outer plate-like elements comprise a grating.

4. The loud-speaker in combination with a device for producing lighting effects as claimed in claim 1, wherein only said inner plate-like element is movable, and further wherein said outer plate-like element is fixed.

5. The loud-speaker in combination with a device for producing lighting effects as claimed in claim 1, further comprising a housing, wherein said inner plate-like element is provided on its said circular circumference with a flange oriented perpendicularly to its said surface, said flange being movably supported via rollers within said housing.

6. The loud-speaker in combination with a device for producing lighting effects as claimed in claim 5, wherein at least one of said rollers is arranged so that said inner plate-like element performs said rotating movement via a drive means connected to said at least one of said rollers.

7. The loud-speaker in combination with a device for producing lighting effects as claimed in claim 1, wherein said inner plate-like element is movably supported on a bearing means attached to said outer plate-like element.

8. The loud-speaker in combination with a device for producing lighting effects as claimed in claim 2, further comprising at least one driver member fixed on said speaker cone of said loud-speaker, said at least one driver member having a free end frictionally engaging said inner plate-like element.

9. The loud-speaker in combination with a device for producing lighting effects as claimed in claim 8, wherein said at least one driver member comprises a wire bent in the shape of a section of a helix.

10. The loud-speaker in combination with a device for producing lighting effects as claimed in claim 8, wherein said inner plate-like element further comprises a protruding ring which is contacted by said free end of said at least one driver member.

11. The loud-speaker in combination with a device for producing lighting effects as claimed in claim 8, wherein said at least one driver member is connected with said speaker cone by glueing.

12. The loud-speaker in combination with a device for producing lighting effects as claimed in claim 8, wherein said free end of said at least one driver member whch contacts said inner plate-like element is provided with a cap of sound-absorbing material.

13. The loud-speaker in combination with a device for producing lighting effects as claimed in claim 1, wherein said speaker cone has an interior; said light source being arranged within said interior of said speaker cone of said loud speaker, said light source illuminating a surface of said inner plate-like element which is facing said speaker cone.

14. The loud-speaker in combination with a device for producing lighting effects as claimed in claim 13, wherein said speaker cone has an inner side, said inner side of said speaker cone being provided with a light-reflecting coating.

15. The loud-speaker in combination with a device for producing lighting effects as claimed in claim 1, wherein said outer plate-like element has a outer surface, said light source being spaced from said outer surface of said outer plate-like element so as to illuminate said outer surface of said outer plate-like element, and further wherein said inner plate-like element is provided with a light-reflecting coating on a surface thereof which faces said outer plate-like element.

* * * * *

UNITED STATES PATENT AND TRADEMARK OFFICE

CERTIFICATE OF CORRECTION

PATENT NO. : 4,817,163

DATED : March 28, 1989

INVENTOR(S) : Erich Stastny

It is certified that error appears in the above-identified patent and that said Letters Patent is hereby corrected as shown below:

Column 3. line 12. delete "supporteda" and insert ---- supported a ----.

In the Claims

Column 4. line 25. delete "claimd" and insert ---- claimed ----.

Column 5. line 13. delete "whch" and insert ---- which ----.

In the Abstract

Line 2. delete "speakers" and insert ---- effects. The loudspeaker ----.

Signed and Sealed this

Fifth Day of December, 1989

*Attest:*

JEFFREY M. SAMUELS

*Attesting Officer*

*Acting Commissioner of Patents and Trademarks*